US010258109B2

(12) United States Patent
Midorikawa

(10) Patent No.: US 10,258,109 B2
(45) Date of Patent: Apr. 16, 2019

(54) STRUCTURE FOR ATTACHING SHOELACE WINDING APPARATUS

(71) Applicant: JAPANA CO., LTD., Nagoya, Aichi (JP)

(72) Inventor: Shinobu Midorikawa, Nagoya (JP)

(73) Assignee: JAPANA CO., LTD., Nagoya, Aichi (JP)

( * ) Notice: Subject to any disclaimer, the term of this patent is extended or adjusted under 35 U.S.C. 154(b) by 119 days.

(21) Appl. No.: 15/502,391

(22) PCT Filed: Jun. 12, 2015

(86) PCT No.: PCT/JP2015/067004

§ 371 (c)(1),
(2) Date: Mar. 29, 2017

(87) PCT Pub. No.: WO2016/024437

PCT Pub. Date: Feb. 18, 2016

(65) Prior Publication Data

US 2017/0224056 A1 Aug. 10, 2017

(30) Foreign Application Priority Data

Aug. 11, 2014 (JP) ..... 2014-163867

(51) Int. Cl.
*A43C 7/00* (2006.01)
*A43C 11/16* (2006.01)
(Continued)

(52) U.S. Cl.
CPC ..... *A43C 11/165* (2013.01); *A43B 23/02* (2013.01); *A43C 11/00* (2013.01); *A43C 11/20* (2013.01);
(Continued)

(58) Field of Classification Search
CPC ..... Y10T 24/2106; Y10T 24/2142; Y10T 24/2183; Y10T 24/3724; A43C 11/165
See application file for complete search history.

(56) References Cited

U.S. PATENT DOCUMENTS

2008/0172848 A1 7/2008 Chen
2009/0184189 A1* 7/2009 Soderberg ..... A43B 3/0042 242/395
(Continued)

FOREIGN PATENT DOCUMENTS

EP 0412290 7/1990
EP 3044477 7/2016
(Continued)

OTHER PUBLICATIONS 15831265.2, Mar. 14, 2018, Extended European Search Report.

*Primary Examiner* — Robert Sandy
*Assistant Examiner* — Michael S Lee
(74) *Attorney, Agent, or Firm* — Workman Nydegger

(57) ABSTRACT

A structure for attaching a shoelace winding apparatus in which a shoelace winding apparatus can be attached to a shoe is provided. The structure includes a reel that winds a shoelace by being rotated by an operation handle, a ratchet pawl that limits rotation of the reel, and a base member including a substantially cylindrical body that accommodates the reel. The base member includes an annular gear with teeth that engages with the ratchet pawl. The structure includes a base-member attachment cover and a flange portion. The cover includes a substantially cylindrical cover portion with a closed end. The cover portion secures the base member such that the base member is directly attachable and detachable from an outside of an upper section and held in the cover portion. The flange portion protrudes from the circumference of the cover portion and conforms to the shape of the shoe.

10 Claims, 9 Drawing Sheets

(51) Int. Cl.

| | |
|---|---|
| ***A43B 23/02*** | (2006.01) |
| ***A43C 11/00*** | (2006.01) |
| ***A43C 11/20*** | (2006.01) |

(52) U.S. Cl.
CPC ..... *Y10T 24/2183* (2015.01); *Y10T 24/3724* (2015.01)

(56) References Cited

U.S. PATENT DOCUMENTS

| | | | | |
|---|---|---|---|---|
| 2010/0101061 | A1* | 4/2010 | Ha | A43B 3/0042 24/712.5 |
| 2010/0139057 | A1 | 6/2010 | Soderberg et al. | |
| 2011/0266384 | A1 | 11/2011 | Goodman et al. | |
| 2013/0092780 | A1* | 4/2013 | Soderberg | A43C 11/165 242/396.4 |
| 2013/0269219 | A1* | 10/2013 | Burns | A43C 11/165 36/136 |
| 2016/0120267 | A1* | 5/2016 | Burns | A44B 11/065 24/68 C |
| 2018/0160775 | A1* | 6/2018 | Pollack | A43C 7/00 |

FOREIGN PATENT DOCUMENTS

| | | |
|---|---|---|
| JP | 5-211906 | 8/1993 |
| JP | 7-000208 | 1/1995 |
| JP | 7-073525 | 8/1995 |
| JP | 2009-504210 | 2/2009 |
| JP | 2011-514175 | 5/2011 |
| JP | 2013-525007 | 6/2013 |
| JP | 2015-000293 | 1/2015 |
| JP | 2015-000297 | 1/2015 |
| KR | 10 2010 0111031 | 10/2010 |
| KR | 101053551 | 8/2011 |
| WO | WO2013/138759 | 9/2013 |
| WO | WO 2015/039052 | 3/2015 |

* cited by examiner (A)

(B)

(A)

(B)

STRUCTURE FOR ATTACHING SHOELACE WINDING APPARATUS

FIELD OF THE INVENTION

The present invention relates to a structure for attaching a shoelace winding apparatus.

BACKGROUND OF THE INVENTION

FIG. 9 shows a shoelace winding apparatus 300 that is proposed by the applicant of the present application. The shoelace winding apparatus 300 has a shoelace winding system that includes a reel 302, which is driven by an operation handle 301 to rotate and wind the shoelace, ratchet pawls 303, which limit rotation of the reel 302, and a base member 304, which includes a substantially cylindrical body that has one closed end and accommodates the reel 302. The base member 304 has an inner circumferential surface including an annular gear, which has a plurality of teeth that engages with the ratchet pawls 303.

A flange 305 is formed integrally with the lower section of the base member 304. The shoelace winding apparatus 300 is attached to a shoe by sewing the flange 305 directly to the shoe (Patent Documents 1 and 2).

Patent Document 3, which is disclosed by another applicant, describes another structure for attaching a shoelace winding apparatus having a shoelace winding system.

This shoelace winding apparatus is also attached to a shoe by sewing a flange directly to the shoe. The flange is formed integrally with the base member with an annular gear.

The present invention relates to a structure for attaching a shoelace winding apparatus that is improved over the structures for attaching a shoelace winding apparatus having shoelace winding systems described above.

Patent Document 4 describes a shoelace winding apparatus that, instead of using the shoelace winding system described above, limits the rotation direction of the reel using teeth on an annular ratchet and teeth on the annular reel.

Patent Documents 5 and 6 each describe a shoelace winding apparatus that includes an annular gear and ratchet pawls. This shoelace winding apparatus is attached to a shoe by directly attaching a member including a reel accommodation section to the shoe.

Further, Patent Document 7 describes a shoelace winding apparatus that, instead of using the shoelace winding system described above, limits the rotation direction of a disc-shaped ratchet wheel using pawls on a lever arm.

PRIOR ART DOCUMENTS

Patent Documents

Patent Document 1: Japanese Patent Application No. 2013-127574

Patent Document 2: Japanese Patent Application No. 2013-127612

Patent Document 3: Japanese National Phase Laid-Open Patent Publication No. 2013-525007

Patent document 4: Japanese Laid-Open Patent Publication No. H7-208

Patent document 5: Japanese Laid-Open Patent Publication No. H7-73525

Patent Document 6: European Patent Publication No. 0412290

Patent document 7: Japanese Laid-Open Patent Publication No. H5-211906

SUMMARY OF THE INVENTION

Problems that the Invention is to Solve

The structures for attaching a shoelace winding apparatus described in Patent Documents 1 to 3 have following problems 1) to 5).

1) The shoelace winding system is fixed by inserting a metal screw into the plastic shaft of the base member with the annular gear. Thus, excessive tightening of the screw or the force applied by the screw may strip the threaded bore in the shaft, causing insufficient fastening between the shaft and the screw. This may result in malfunction or removal of the shoelace winding system.

2) In case of wear or damage of the annular gear, the base member, which is sewn to the shoe, needs to be removed from the shoe and replaced to repair the shoelace winding apparatus. This involves re-sewing of the outer layer of the shoe, which is practically difficult or requires an excessive amount of costs, time, and effort.

3) When the base member with the annular gear receives deforming stress from the shoe, the annular gear may deform, resulting in loosening of the shoelace or malfunction of the shoelace winding apparatus.

The rigidity of the base member with the annular gear may be increased to avoid the problems described above. However, increased rigidity may increase the size or weight of the base member, decreasing the comfort of the shoes.

4) The shape of the base member needs to correspond with the shape of the section of the shoe to which the shoelace winding apparatus is attached, or the shoe may be uncomfortable to wear or damaged.

5) The shoelace and the base member may rub against each other. This may cut the shoelace or damage the base member.

The structure for attaching a shoelace winding apparatus described in Patent Document 4 attaches the internal mechanism including the reel and ratchet to the base plate by inserting a screw from the back side of the shoelace winding apparatus. Thus, any defect of the internal mechanism requires the entire shoelace winding apparatus to be removed from the shoe.

In the structure for attaching the shoelace winding apparatus described in Patent Documents 5 and 6, the shoelace winding apparatus is fixed to a shoe by fitting the housing of the shoelace winding apparatus into a receiving recess formed in the shoe. Thus, if the housing is fixed firmly, the shoelace winding apparatus may be difficult to remove from the receiving recess, hindering repair or replacement.

In the structure for attaching a shoelace winding apparatus described in Patent Document 7, the shoelace winding apparatus is bound to a shoe by the shoelace, resulting in unstable attachment of the shoelace winding apparatus to the shoe.

It is an objective of the present invention to provide a structure for attaching a shoelace winding apparatus that solves all the problems of the conventional structures for attaching a shoelace winding apparatus described above, facilitates attachment of the shoelace winding apparatus to a shoe, achieves firm attachment, allows for stable operation of the shoelace winding system, and reduces malfunction of the shoelace winding apparatus.

Another objective of the present invention is to provide a structure for attaching a shoelace winding apparatus that allows for easy removal of the shoelace winding system from the shoe in case of malfunction of the shoelace winding apparatus, minimizes the components that need to be replaced, and facilitates maintenance work.

Means for Solving the Problems

The main characteristic of the present invention is a structure for attaching a shoelace winding apparatus, in which the shoelace winding apparatus includes a reel that is driven by an operation handle to rotate and wind a shoelace, a ratchet pawl that limits rotation of the reel, and a base member including a substantially cylindrical body, which has one closed end and accommodates the reel. The base member has an inner circumferential surface including an annular gear with a plurality of teeth that engages with the ratchet pawl. The structure for attaching a shoelace winding apparatus includes a base-member attachment cover that includes a cover portion and a flange portion. The cover portion is substantially cylindrical and has one closed end. The cover portion is allowed to secure the base member such that the base member is directly attachable and detachable from outside of an upper section and held in the cover portion. The flange portion protrudes from a circumference of the cover portion and conforms to a shape of the shoe.

The cover portion or the base member of the present invention preferably includes a lock mechanism that locks the base member in a position secured to the cover portion.

The lock mechanism, which locks the base member in a position secured to the cover portion, preferably includes a retention projection, a retention depression, an anti-rotation projection, and an anti-rotation depression. The retention projection and the retention depression are formed in a circumferential surface of the cover portion and a circumferential surface of the base member so as to engage with each other when the base member is rotated to limit outward removal of the base member. The anti-rotation projection and the anti-rotation depression are formed in an inner bottom surface of the cover portion and a lower surface of the base member so as to engage with each other to maintain engagement between the retention projection and the retention depression.

The anti-rotation projection and the anti-rotation depression of the present invention may be configured to be accessible from outside of the base member so as to be disengaged from each other.

The cover portion of the present invention may include a shoelace inlet that opens to a cylindrical inner surface. A tubular shoelace guide section may extend from the shoelace inlet and along the flange portion, a diameter of the shoelace guide section may be reduced near the shoelace inlet. The shoelace guide section may be configured to receive a shoelace insertion tube such that a tip of the shoelace insertion tube is placed near the shoelace inlet.

A gap preferably exists between an outer circumferential surface of the base member and an inner circumferential surface of the cover portion of the present invention so that deformation of the cover portion does not deform the base member.

The flange portion of the present invention may include a plurality of sections that are individually deformable.

The cover portion of the present invention preferably has a lower surface that is curved to conform to the shape of the shoe.

Effects of the Invention

The structure for attaching a shoelace winding apparatus according to the present invention described above allows for easy removal of the shoelace winding system, which includes an operation handle and ratchet pawls, from the base member while the base-member attachment cover is firmly fixed to the shoe. Moreover, the embodiment allows for easy removal of the base member itself from the base-member attachment cover, facilitating repair and replacement of the components.

In the structure for attaching a shoelace winding apparatus according the present invention, the cover portion or the base member may include a lock mechanism that locks the base member in a position secured to the cover portion. This ensures that the base member is secured to the cover portion. The base member can be easily removed from the cover portion by releasing the lock mechanism.

The lock mechanism, which locks the base member in a position secured to the cover portion, may include a retention projection and a retention depression that are formed in a circumferential surface of the cover portion and a circumferential surface of the base member so as to engage with each other when the base member is rotated to limit outward removal of the base member, and an anti-rotation projection and an anti-rotation depression that are formed in the inner bottom surface of the cover portion and the lower surface of the base member so as to engage with each other to maintain the engagement between the retention projection and the retention depression. This structure can easily limit outward removal of the base member simply by rotating the base member.

The base member can be removed from the cover portion by disengaging the anti-rotation projection and depression.

Further, the anti-rotation projection and depression may be configured to be accessible from the outside of the base member so as to be disengaged from each other. This facilitates removal of the base member from the cover portion.

The cover portion of the present invention may include a shoelace inlet that opens to a cylindrical inner surface, a tubular shoelace guide section may extend from the shoelace inlet and along the flange portion, the diameter of the shoelace guide section may be reduced near the shoelace inlet, and the shoelace guide section may be configured to receive a shoelace insertion tube such that the tip of the shoelace insertion tube is placed near the shoelace inlet. In such a structure, the shoelace insertion tube guides the shoelace to the vicinity of the shoelace inlet, limiting direct rubbing between the shoelace and the base-member attachment cover or the base member. This limits cutting of the shoelace and damage of the base-member attachment cover and the base member.

A gap may exist between the outer circumferential surface of the base member and the inner circumferential surface of the cover portion. As such, deformation of the cover portion does not deform the base member. This ensures normal operation of the shoelace winding apparatus. In addition, the base member can be thin and light.

The flange portion may include a plurality of sections that are individually deformable. Thus, the base-member attachment cover can be easily attached conforming to the shape of the shoe. In addition, such a structure limits malfunction of the shoelace winding apparatus, which would otherwise occur when the cover portion is distorted.

Further, the cover portion may have a lower surface that is curved to conform to the shape of the shoe. Such a structure attaches the shoelace winding apparatus to a shoe without reducing the comfort of the shoe.

DETAILED DESCRIPTION OF THE INVENTION

The present invention relates to a structure for attaching a shoelace winding apparatus that includes a reel that is driven by an operation handle to rotate and wind a shoelace, a ratchet pawl that limits rotation of the reel, and a base member including a substantially cylindrical body, which has one closed end and accommodates the reel, wherein the base member has an inner circumferential surface including an annular gear, which includes a plurality of teeth that engages with the ratchet pawl. The structure for attaching a shoelace winding apparatus has a base-member attachment cover that includes a cover portion and a flange portion. The cover portion is substantially cylindrical and has one closed end, wherein the cover portion is configured to secure the base member such that the base member is directly attachable and detachable from the outside of the upper section and held in the cover portion. The flange portion protrudes from the circumference of the cover portion and conforms to the shape of the shoe. Preferred embodiments of the present invention are described below.

Figure 4:
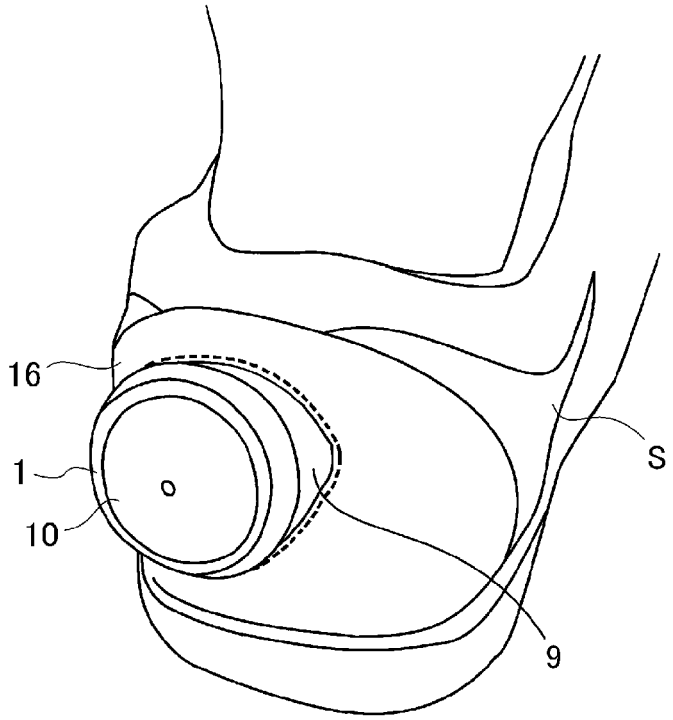
FIG. 4 includes diagrams showing the heel section of a shoe having a structure for attaching a shoelace winding apparatus according to an embodiment of the present invention, where diagram (A) is a perspective view of the heel section, and diagram (B) is a horizontal cross-sectional view of the inner structure of the heel section of the shoe.
Figure 4:
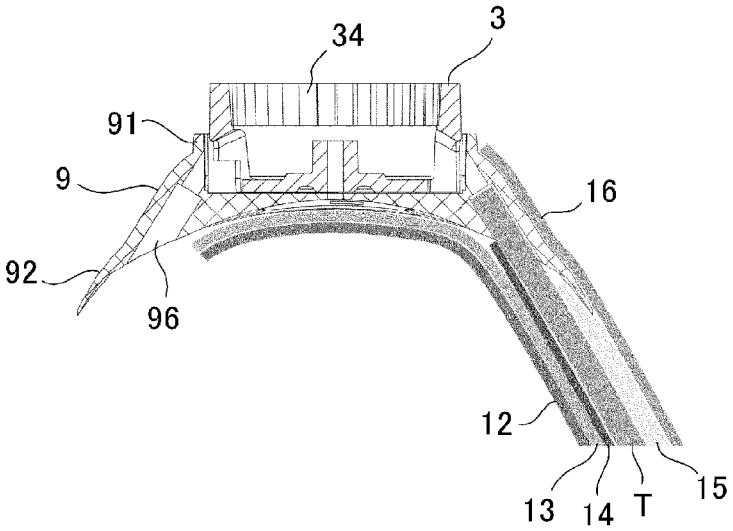

A structure for attaching a shoelace winding apparatus according to one embodiment of the present invention will now be described. In this embodiment, the structure for attaching a shoelace winding apparatus is used to attach a shoelace winding apparatus 1 to the heel section of a shoe S, which may be an athletic shoe or a golf shoe, as shown in FIG. 4(A).

The shoelace winding apparatus 1 tightens the instep and the rim of the opening of the shoe S using a shoelace 2, which is a plastic-coated metal wire.

Figure 1:
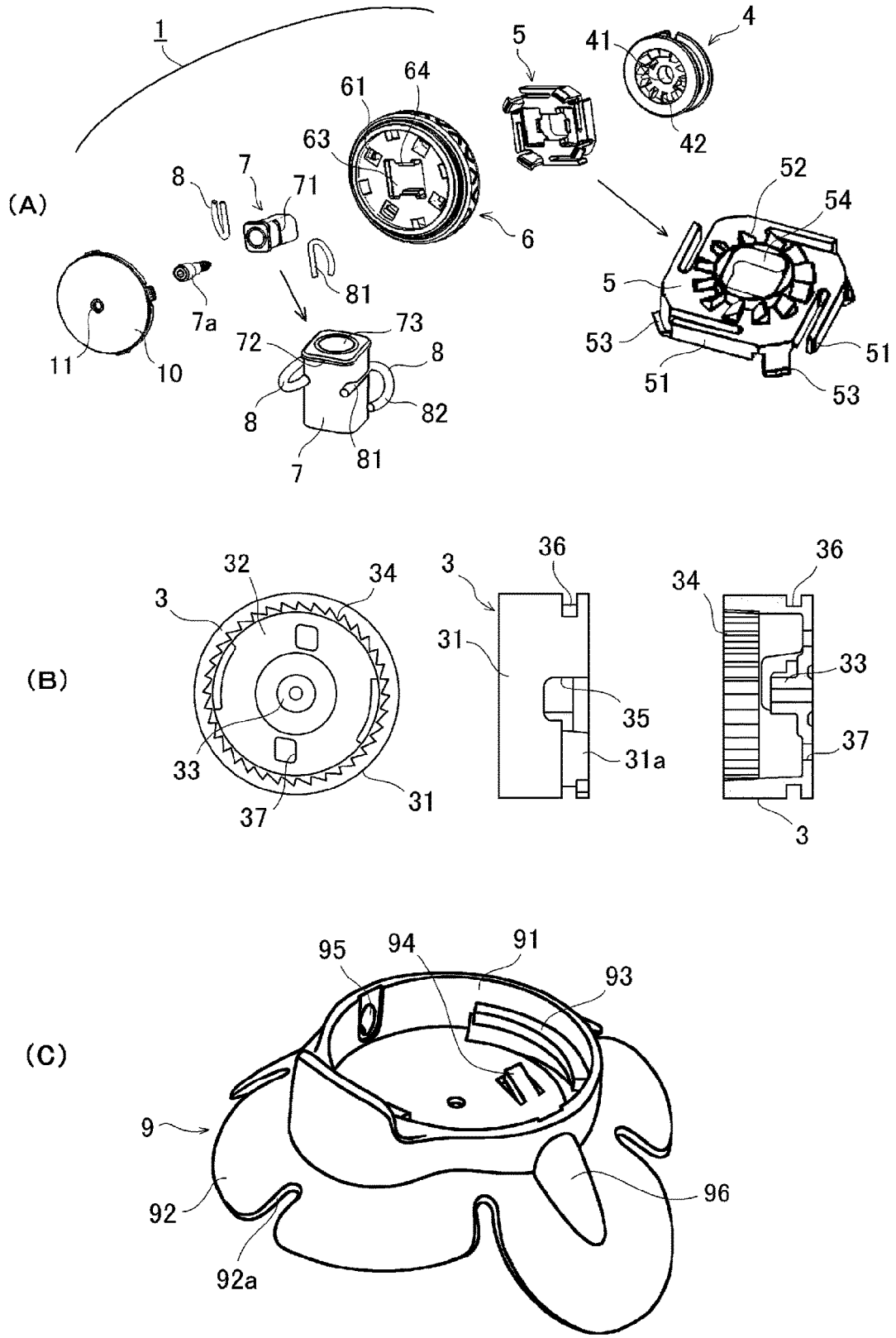
FIG. 1 includes diagrams showing a structure for attaching a shoelace winding apparatus and a shoelace winding system according to one embodiment of the present invention, where diagram (A) is an exploded perspective view showing components of the shoelace winding apparatus, such as an operation handle and a reel, diagram (B) provides a plan view, a side view, and a cross-sectional view of a base member, and diagram (C) is a perspective view of a base-member attachment cover.
Figure 2:
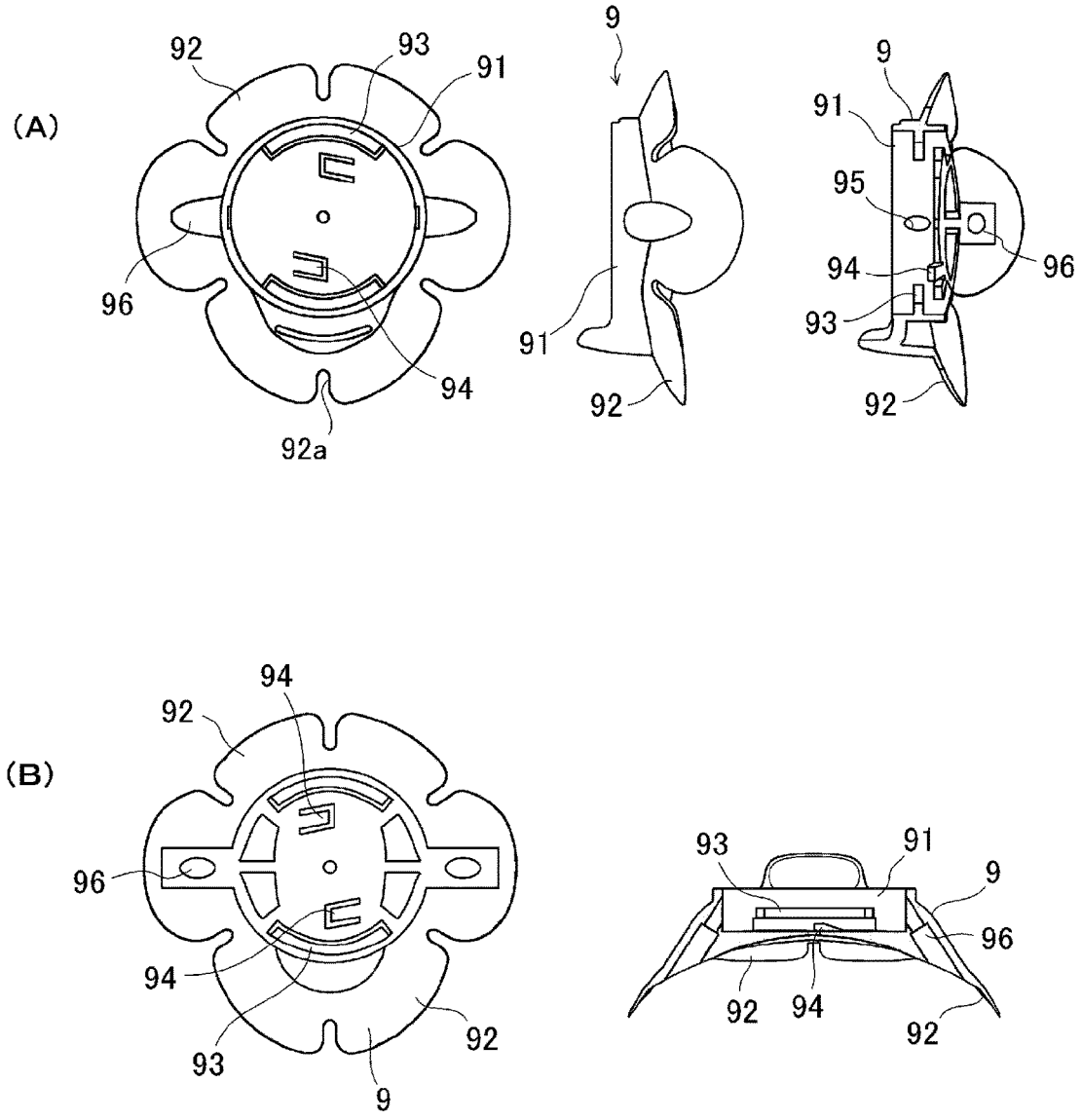
FIG. 2 includes diagrams showing a base-member attachment cover that is an embodiment of a structure for attaching a shoelace winding apparatus according to the present invention, where diagram (A) provides a plan view, a side view, and a cross-sectional view of the base-member attachment cover, and diagram (B) provides a bottom view and a cross-sectional view of the base-member attachment cover.

As shown in FIG. 1, the shoelace winding apparatus 1 has a shoelace winding system that includes a base member 3, which includes an annular gear 34 described below, a reel 4 for winding the shoelace 2, a stopper 5, which has four ratchet pawls 51 for controlling rotation and stopping of the reel 4, an operation handle 6 for driving the reel 4 to rotate, a shaft 7, which is rotationally fastened to the base member 3 to attach the operation handle 6 and the stopper 5 to the base member 3, and springs 8, each having one end supported by the shaft 7.

The base member 3 includes a cylindrical body 31 with one closed end, which is substantially cylindrical as a whole and has a closed end. A reel accommodation section 32 for accommodating the reel 4 is formed in the base member 3. A rotation shaft 33 projects from the center in the bottom of the reel accommodation section 32 to support the reel 4.

The annular gear 34, which includes a plurality of teeth that engages the ratchet pawls 51, is formed in the inner circumferential surface of the upper section of the cylindrical body 31 with one closed end of the base member 3.

The annular gear 34 cooperates with the ratchet pawls 51 to form a ratchet mechanism. The ratchet pawls 51 are elongated planar sections formed in the substantially tetragonal stopper 5. The annular gear 34 has a sawtooth cross-section that permits the ratchet pawls 51 to move only in the direction that winds the shoelace 2 (the forward rotation in the clockwise direction as viewed in FIG. 5(E)).

The base member 3 also includes two shoelace outlets 35, which are spaced apart by 180 degrees. Each shoelace outlet 35 extends from the bottom of the reel accommodation section 32 and opens to the side. The shoelace outlets 35 allow the shoelace 2 to be inserted into the reel accommodation section 32 and wound around the reel 4.

The base member 3 is attached to the heel section of the shoe S by a base-member attachment cover 9, which includes a cover portion 91 and a flange portion 92. The cover portion 91 is substantially cylindrical and has one closed end. The cover portion 91 is configured to secure the base member 3 such that the base member 3 is directly attachable and detachable from the outside of the upper section and held in the cover portion 91. The thin flange portion 92 protrudes from the circumference of the cover portion 91 and conforms to the shape of the shoe.

The thin, planar flange portion 92 is fixed to the shoe S by sewing, thereby firmly securing the shoelace winding apparatus 1 to the shoe S.

In the present example, a gap of 0.5 to 1.0 mm exists between the outer circumferential surface of the base member 3 and the inner circumferential surface of the cover portion 91 so that deformation of the cover portion 91 does not directly affect the base member 3.

Thus, the cover portion 91 and the base member 3 may be thin and light, and the shoelace winding apparatus 1 can still function in a stable manner. In addition, the wearer does not feel the hardness of the shoelace winding apparatus 1 attached to the shoe S. This avoids discomfort.

The back surfaces of the cover portion 91 and the flange portion 92 are curved in a substantially spherical shape to conform to the shape of the heel section of the shoe S.

In the present example, the height of the cover portion 91 is about the same as the thickness of the reel 4. That is, the height of the cover portion 91 is set such that the cover portion 91 covers approximately half of the base member 3 from the bottom.

The flange portion 92 includes slits 92*a*, which divide the flange portion 92 into sections each having the shape of a petal. These petal sections can easily deform individually.

Thus, the flange portion 92 can deform conforming to the shapes of different parts of the shoe S to which the base-member attachment cover 9 is attached. This facilitates the attachment. In addition, the flange portion 92 can easily deform conforming to deformation of the shoe S during use, reducing any discomfort caused by attaching the shoelace winding apparatus 1.

Further, the petal sections of the flange portion 92 can deform individually. This limits deformation of the cover portion 91, which would otherwise be caused by deformation of the shoe S.

In the present embodiment, the cover portion 91 and the base member 3 include a lock mechanism that locks the base member 3 in a position secured to the cover portion 91.

The lock mechanism includes following structures (i) and (ii) that serve as retention projections and depressions and structures (iii) and (iv) that serve as anti-rotation projections and depressions.

(i) Retention protrusions 93 protrude along the inner circumferential surface of the cover portion 91. The retention protrusions 93 limit outward removal of the base member 3 when the base member 3 is rotated.

The retention protrusions 93 extend parallel to the inner bottom surface of the cover portion 91. The positions of the two protrusions 93 are spaced apart by 180 degrees.

(ii) Retention grooves 36 are formed in the outer circumferential surface of the base member 3 so as to engage with the retention protrusions 93 when the base member 3 is rotated to limit outward removal of the base member 3.

The retention grooves 36 extend parallel to the lower surface (the outer bottom surface or back surface) of the base member 3. The positions of the two grooves 36 are spaced apart by 180 degrees.

Figure 3:
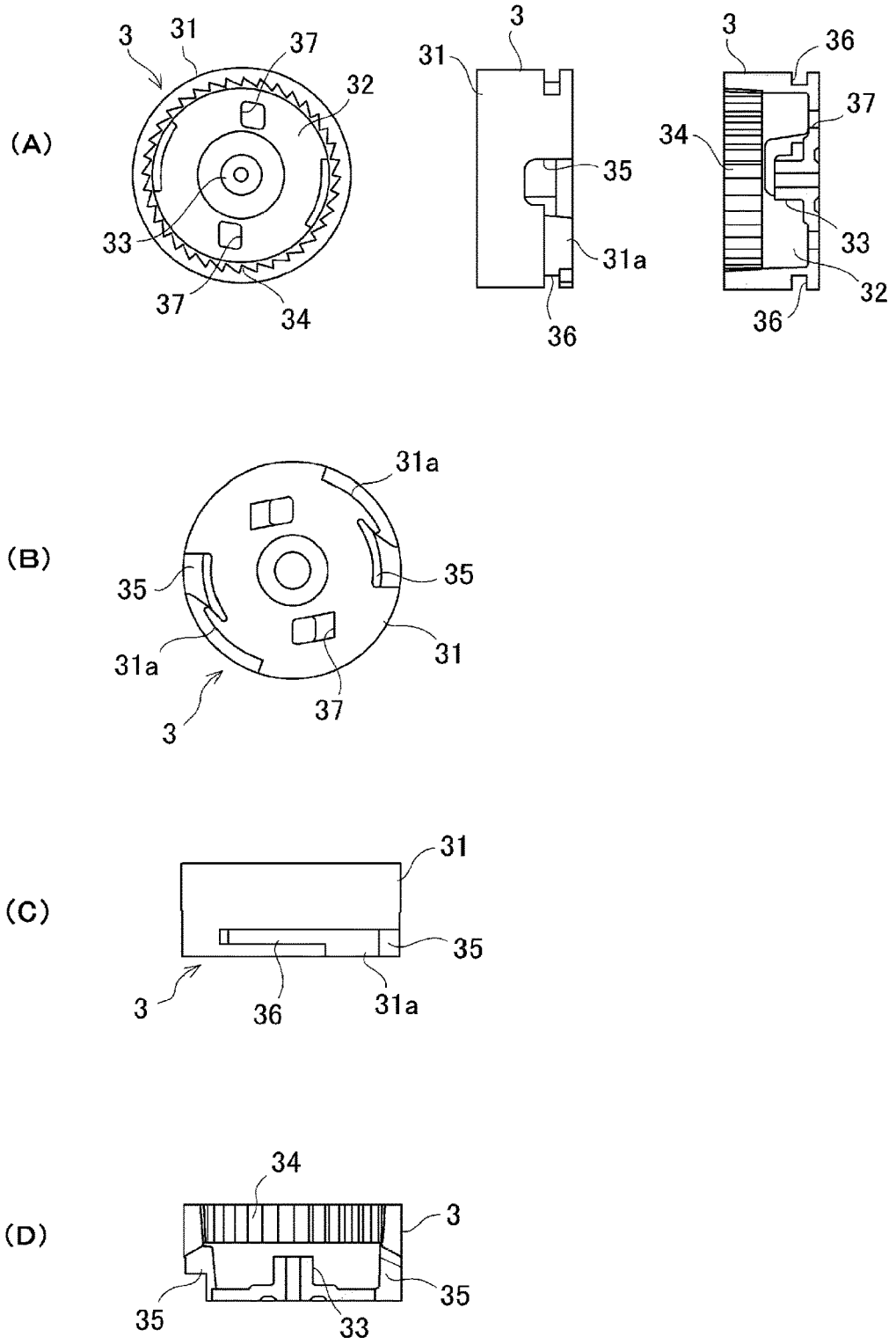
FIG. 3 includes diagrams showing a base member that is an embodiment of a structure for attaching a shoelace winding apparatus according to the present invention, where diagram (A) provides a plan view, a side view, and a cross-sectional view of the base member, diagram (B) is a bottom view of the base member, diagram (C) is a front view of the base member, and diagram (D) is a cross-sectional view of the base member.
Figure 6:
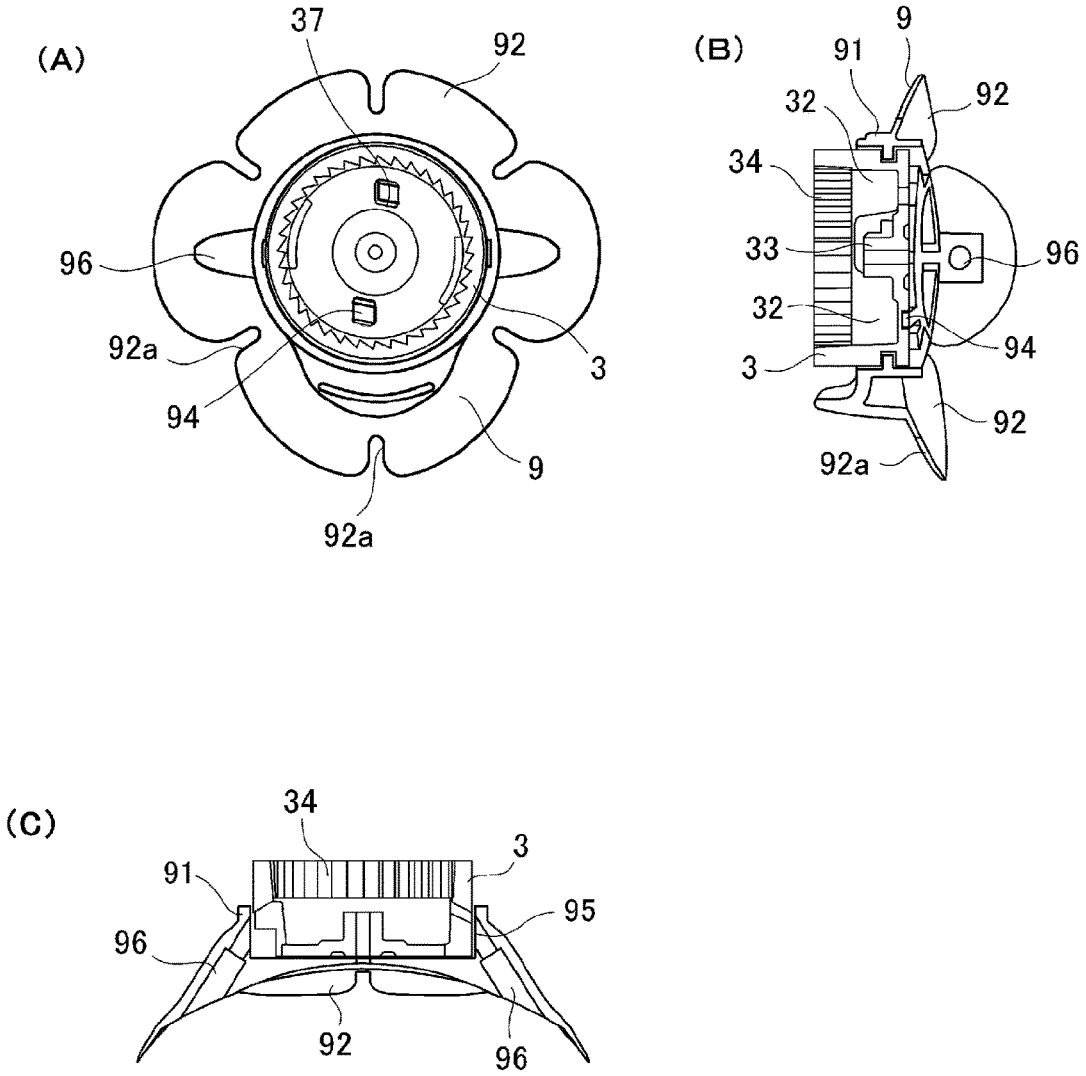
FIG. 6 includes diagrams showing the base-member attachment cover according to an embodiment of the present invention to which a base member is attached, where diagram (A) is a plan view, and diagrams. (B) and (C) are cross-sectional views.

When the retention protrusions 93 are in engagement with the retention grooves 36, the retention protrusions 93 abut against the ends of the retention grooves 36 (the left end as viewed in FIG. 3(C)) and prevent counterclockwise rotation of the base member 3 beyond this position (referred to as "stop position," which is shown in FIG. 6(A)).

The cylindrical body 31 with one closed end, which is substantially cylindrical and forms the base member 3, includes a lower outer circumference section 31*a* extending from the right end of each retention groove 36 to the corresponding shoelace outlet 35. The lower outer circumference section 31*a* has a smaller diameter than the other section to provide space for inserting the retention protrusion 93.

(iii) Anti-rotation projections 94, which are plate springs, extend from the inner bottom surface of the cover portion 91 to maintain engagement between the retention projections and depressions in the "stop position".

The positions of the two anti-rotation projections 94 are spaced apart by 180 degrees on the inner bottom surface of the cover portion 91. Each projection 94 is inclined so that the height of the projection 94 gradually increases toward the distal end.

The orientations of the inclined anti-rotation projections 94 are 180 degrees opposite from each other.

(iv) Anti-rotation through-holes 37 are formed in the lower surface (the outer bottom surface) of the base member 3. The through-holes 37 engage with the anti-rotation projections 94 in the "stop position" to maintain engagement between the retention projections and depressions.

The positions of the two anti-rotation through-holes 37 are spaced apart by 180 degrees in the inner bottom surface of the base member 3. Each through-hole 37 is inclined and gradually deepens so that the corresponding anti-rotation projection 94 fits into the through-hole 37.

Once the anti-rotation projections 94 are fit into the anti-rotation through-holes 37 in the "stop position," the base member 3 cannot rotate also in the direction that removes the base member 3 (the clockwise direction).

To release the anti-rotation projections 94 that are fit in the anti-rotation through-holes 37 in the "stop position," the two anti-rotation projections 94 are pressed simultaneously from the side of the base member 3 where the reel accommodation section 32 is located; that is, the anti-rotation projections 94 are accessible from the outside of the base member 3. The base member 3 is then rotated in the direction that removes the base member 3.

This example is configured such that the simultaneous pressing of the anti-rotation projections 94 is achieved using a tool (not shown) that includes two separate projections used to attach and remove spikes.

In the present example, the base member 3 is urged in the counterclockwise direction, that is, urged in the direction that maintains the base member 3 in the "stop position," when the shoelace 2 is tightened. This limits rotation of the base member 3 in the direction that removes the base member 3 while the shoelace winding apparatus 1 is used.

In addition, in the "stop position," the shoelace outlets 35 of the base member 3 are always aligned with shoelace inlets 95 formed in the cover portion 91.

The cover portion 91 of the base-member attachment cover 9 includes two shoelace inlets 95, which are located between the two retention protrusions 93 and open to the cylindrical inner surface of the cover portion 91.

Tubular shoelace guide sections 96 extend from the shoelace inlets 95 and along the flange portion 92. The inner diameter of each shoelace guide section 96 is reduced near the corresponding shoelace inlet 95. A shoelace insertion tube T is inserted in each shoelace guide section 96 such that the tip of the shoelace insertion tube T is placed near the shoelace inlet 95. The reduced diameter of the shoelace guide section 96 limits further advancement of the tip of the shoelace insertion tube T.

The reel 4 includes a shaft receptacle 41 in its center. The inner surface of the shaft receptacle 41 receives the rotation shaft 33 of the base member 3 such that the reel 4 is rotational in the reel accommodation section 32.

The upper section of the reel 4 includes a plurality of fins 42. The fins 42 engage with fins 52 that are formed in the lower section of the stopper 5 to transfer rotation of the operation handle 6 to the reel 4.

Coupling pawls 53 extend from the four corners of the stopper 5 and engage with engagement holes 61 extending through the operation handle 6. The stopper 5 is thus fit to the inner side (the lower side) of the operation handle 6 and integrated with the operation handle 6. The stopper 5 is arranged between the reel 4 and the operation handle 6 so as to assume a lock state in which the stopper 5 transfers rotation of the operation handle 6 to the reel 4 and a release state in which the stopper 5 disconnects the reel 4 from the operation handle 6 so that the reel 4 can rotate freely.

The shaft 7 is fastened to the base member 3 by a screw 7*a* to rotationally attach the integrated operation handle 6 and stopper 5 to the base member 3. The shaft 7 holds and guides the integrated operation handle 6 and stopper 5 such that the operation handle 6 and the stopper 5 are movable between a lock position near the base member 3 (FIG. 8(A)) and a release position away from the base member 3 (FIG. 8(B)).

The shaft 7 has the shape of a quadratic prism and includes shaft receptacles 71, which are cutout sections formed in two opposite sides of the shaft 7 and extended in a direction perpendicular to the axial direction of the shaft 7. Each shaft receptacle 71 receives a straight first end (a shaft section 81) of the corresponding spring 8 so that the shaft 7 pivotally supports the springs 8.

Each spring 8, which is curved and substantially has the shape of letter U as a whole, also includes a curved spring section 82 on the other end. The spring section 82 abuts against an engagement portion 62 formed in the inner surfaces of the integrated operation handle 6 and the stopper 5.

Each engagement portion 62, against which the second end (the spring section 82) of the corresponding spring 8 abuts, is located in the narrowest part at the outer end of a wedge-shaped spring accommodation cavity, which is formed in the border section between the operation handle 6 and the stopper 5.

A disc-shaped cap 10 is fit to the upper side of the operation handle 6, blocking entry of foreign matter such as dirt into the shoelace winding apparatus 1.

The cap 10 has a through-hole 11 in its center. The screw 7*a* located on the inner side (the lower side) of the cap 10 may be manipulated with a tool 100 through the through-hole 11 to remove the operation handle 6, the shaft 7, and the reel 4 from the base member 3.

The shoelace 2 may be suitably formed by processing, using a swaging machine, a wire rope in which 49 stainless steel wires with a diameter of 0.11 to 0.13 mm are twisted and by coating the wire rope with nylon plastic.

A method for coupling the components of the shoelace winding apparatus 1 together and attaching the shoelace winding apparatus 1 to a shoe S will now be described.

First, a plurality of shoelace guides (not shown) is attached to the instep of the shoe S, and shoelace insertion tubes T are embedded into the shoe S on opposite sides of the opening of the shoe S so as to extend in the front-rear direction. The shoelace insertion tubes T are arranged such that the rear ends of the tubes T reach the heel section of the shoe S, which includes a lining 12 and a counter 13. A tube cover 14, which is made of a nonwoven fabric, is placed on the inner side of each shoelace insertion tube T, and a cushion material 15, which is made of EVA, is placed on the outer side of the shoelace insertion tube T.

Then, the base-member attachment cover 9 is temporarily attached to the heel section of the shoe S with an adhesive. Here, each shoelace insertion tube T is inserted in the corresponding tubular (or tunnel-shaped) shoelace guide section 96 extending along the flange portion 92 such that the rear end of the tube T reaches the part of the shoelace guide section 96 that is adjacent to the shoelace inlet 95 and has a reduced diameter.

This limits direct rubbing between the shoelace 2 and the base-member attachment cover 9 or the base member 3 near the shoelace inlets 95, reducing wear of the base-member attachment cover 9 and the base member 3.

Then, the flange portion 92 of the base-member attachment cover 9 is sewn to the outer layer 16 of the shoe S with a thread, thereby firmly fixing the base-member attachment cover 9 to the heel section of the shoe S.

Fixing the base-member attachment cover 9 to the shoe S as described above permits the followings to be performed from the outside of the shoe S: 1) attaching the shoelace 2 to the shoe S; 2) attaching the shoelace winding system to the shoe S; 3) removing the shoelace winding system from the shoe S; and 4) removing the shoelace 2 from the shoe S for replacement.

Then, the base member 3 is attached to the cover portion 91 of the base-member attachment cover 9 and locked to prevent removal (refer to the foregoing descriptions on the lock mechanism and FIGS. 5(A) to 5(D)).

Figure 5:
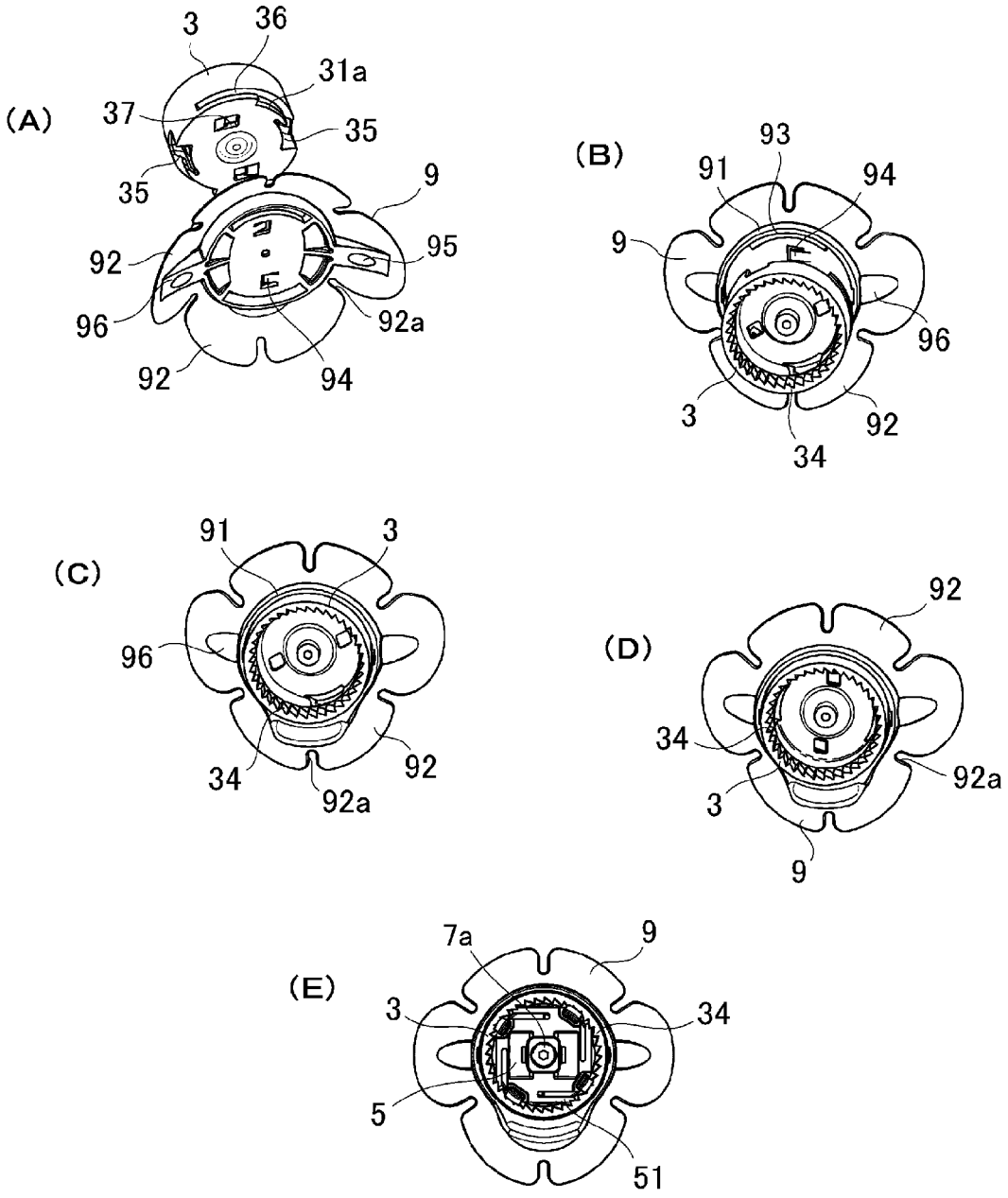
FIG. 5 includes diagrams (A) to (D) showing a sequence for attaching the base member to the base-member attachment cover according to an embodiment of the present invention, and diagram (E) is a plan view showing a state of the ratchet pawls in the base member.

FIGS. 5(B) and 5(C) show how the lower outer circumference sections 31*a* of the base member 3 are brought into alignment with the retention protrusions 93. FIG. 5(D) shows the locked position (FIG. 6), which is achieved by rotating the base member 3 counterclockwise so that the retention protrusions 93 abut against the ends of the respective retention grooves 36.

The projections and depressions forming the lock mechanism are symmetrical about the center points of the cover portion 91 and the base member 3. Thus, the orientation of the base member 3 may be shifted by 180 degrees when attaching the base member 3 to the cover portion 91, and the shoelace outlets 35 of the base member 3 are still aligned with the shoelace inlets 95 of the cover portion 91 so that the base member 3 can be locked.

Then, the shoelace 2 is inserted through a shoelace outlet 35 of the base member 3, a shoelace inlet 95 of the base-member attachment cover 9, a shoelace guide section 96, a shoelace insertion tube T, the shoelace guides that are opposed to one another on the instep of the shoe S (not shown), the other shoelace insertion tube T, the other shoelace guide section 96 of the base-member attachment cover 9, the other shoelace inlet 95, and then the other shoelace outlet 35 of the base member 3.

Figure 7:
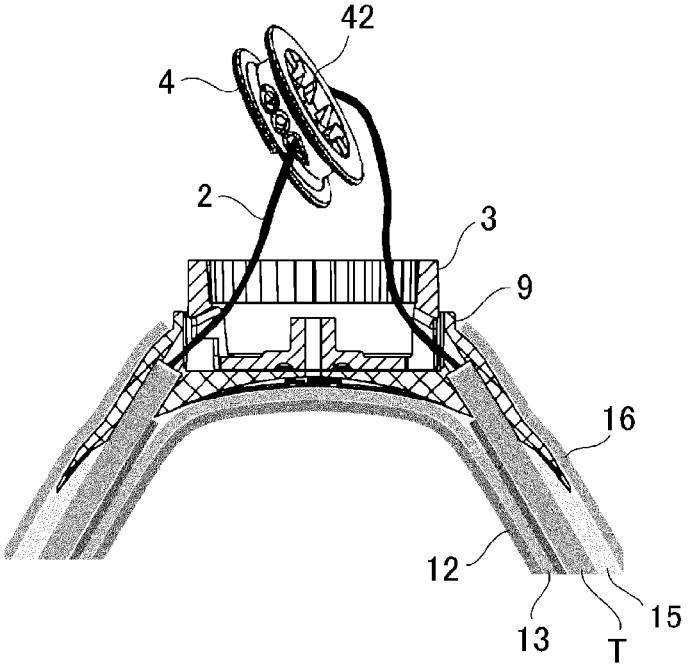
FIG. 7 includes cross-sectional views showing how the reel is attached in the structure for attaching a shoelace winding apparatus according to an embodiment of the present invention.
Figure 7:
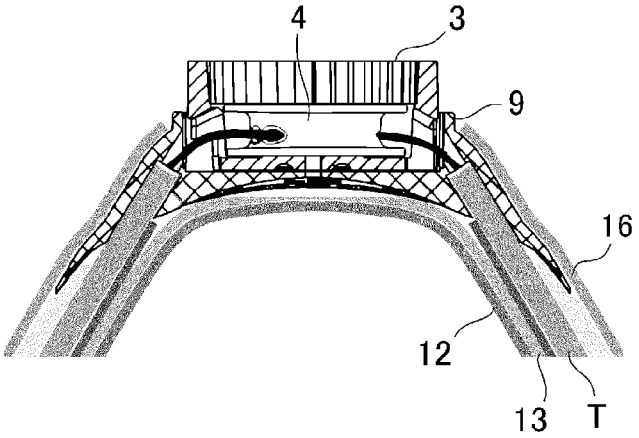

As such, the shoelace 2 is arranged as if to stitch the instep of the shoe S and then extended along opposite sides of the opening of the shoe S. The two ends of the shoelace 2 are pulled out of the heel section of the shoe S as shown in FIG. 7(A).

The two ends of the shoelace 2 are then fixed to the reel 4, and the reel 4 is inserted in the reel accommodation section 32 of the base member 3.

The stopper 5 is fit to the inner side (the lower side) of the operation handle 6 to be integrated with the operation handle 6. The shaft 7 and the springs 8 are coupled to the integrated stopper 5 and operation handle 6.

The shaft 7 is inserted into a shaft hole 63 formed in the center of the operation handle 6 and a shaft hole 54 formed in the center of the stopper 5. The shaft holes 63 and 54 are substantially tetragonal. The spring section 82 of each spring 8 is inserted into the spring accommodation cavity through an extension section of the shaft hole 63 of the operation handle 6. The spring 8 is coupled to the operation handle 6 with the spring section 82 guided to pivot from the inner side toward the narrowest part of the spring accommodation cavity at the outer end.

The shaft 7 includes a flange 72 in its upper end. The flange 72 abuts against a locking step 64 formed in the rim of the shaft hole 63 of the operation handle 6. This limits removal of the operation handle 6 from the shaft 7.

The rim of the shaft hole 54 of the stopper 5 includes an inclined surface facing upward (toward the operation handle). The spring section 82 of each spring 8 is guided by this inclined surface to pivot from the inner side toward the narrowest part of the spring accommodation cavity at the outer end.

After the stopper 5, operation handle 6, shaft 7, and springs 8 are coupled together as described above, the screw 7*a* is inserted into the screw insertion hole 73 of the shaft 7 to attach the shaft 7 and other components to the base member 3.

Finally, the cap 10 is fit to the operation handle 6 to complete the assembly of the shoelace winding apparatus 1.

Since the cap 10 has the through-hole 11 in its center, the shaft 7 and other components may be attached to the base member 3 using the screw 7*a* after the cap 10 is fitted to the operation handle 6.

In disassembling the shoelace winding apparatus 1 for maintenance or repair, the tool 100 is inserted through the through-hole 11 of the cap 10 to remove the screw 7*a*. This allows the integrated stopper 5, operation handle 6, shaft 7, and springs 8 to be collectively removed from the base member 3.

Maintenance or repair is required typically when the shoelace 2 is cut or entangled in the reel accommodation section 32. Thus, the structure that allows the stopper 5, operation handle 6, shaft 7, and springs 8 to be removed from the base member 3 while they are coupled together significantly increases the efficiency of maintenance and repair.

Considering the characteristics such as strength, durability, and elasticity, the components of the shoelace winding apparatus 1 of the present embodiment are made of the following illustrative materials. However, the present invention is not limited to these materials.

Base member 3: Nylon or polycarbonate

Base-member attachment cover 9: Nylon

Reel 4, stopper 5, and shaft 7: POM (polyacetal)

Operation handle 6: Nylon and TPE (thermoplastic elastomer) in the periphery Spring 8: Stainless steel Screw 7*a*: Carbon steel Cap 10: ABS plastic The shoelace winding apparatus 1 configured as described above may be used as follows.

To tighten the shoelace 2 after the shoe S is put on, the operation handle 6 of the shoelace winding apparatus 1 is operated to rotate clockwise in the lock position where the operation handle 6 is located closer to the base member 3. This winds the shoelace 2 around the reel 4.

In this process, the ratchet pawls 51 of the stopper 5 abut against the annular gear 34, preventing rotation of the reel 4 in the direction that loosens the shoelace 2.

To loosen the shoelace 2, the operation handle 6 of the shoelace winding apparatus 1 is pulled upward.

Figure 8:
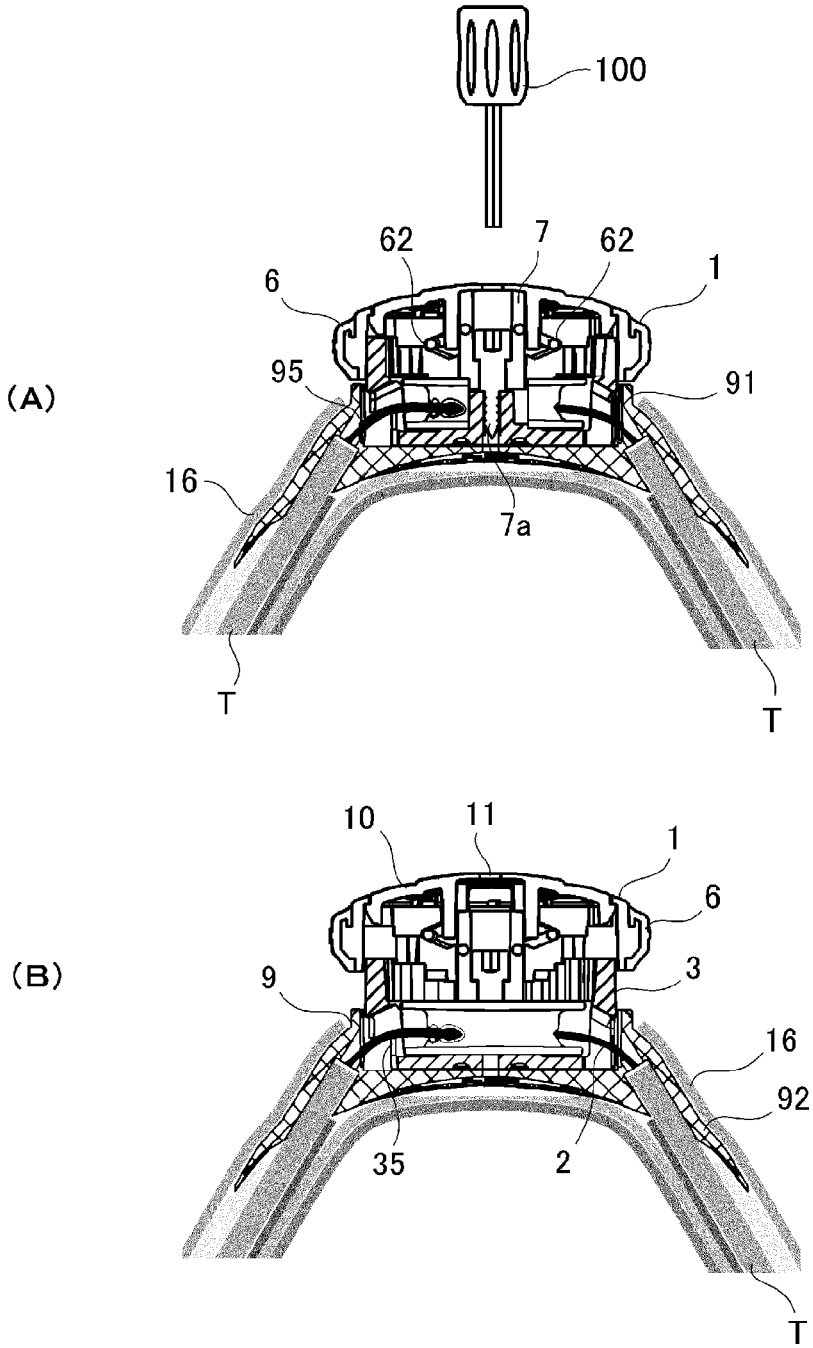
FIG. 8 includes cross-sectional views of components, such as ratchet pawls and a handle, attached by the structure for attaching a shoelace winding apparatus according to an embodiment of the present invention, where diagram (A) shows a position that permits tightening of the shoelace, and diagram (B) shows components in a position that permits loosening of the shoelace.
Figure 9:
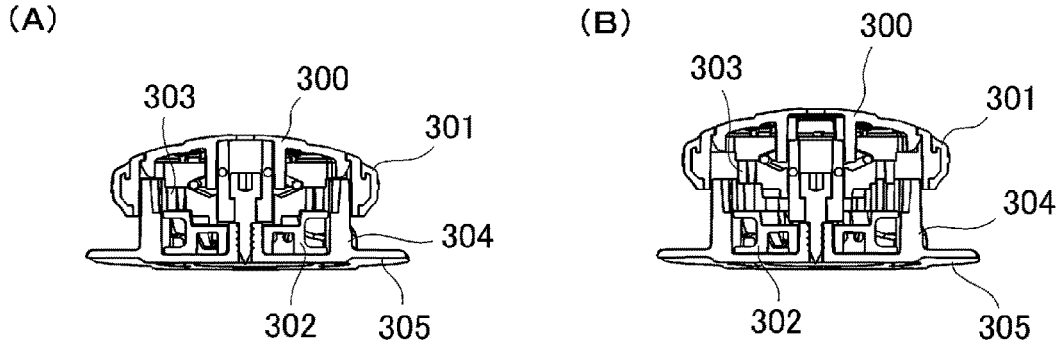
FIG. 9 includes cross-sectional views of a conventional structure for attaching a shoelace winding apparatus that is not improved according to the present invention, where diagram (A) shows a position that permits tightening of the shoelace, and diagram (B) shows the conventional structure in a position that permits loosening of the shoelace.

This compresses the springs 8, and when the springs 8 are moved beyond the reverse positions, where the springs 8 are compressed the most, the operation handle 6 is moved to the release position, where the operation handle 6 is located away from the base member 3 (the state shown in FIG. 8(B)).

The second end (the spring section 82) of each spring 8 remains in contact with the corresponding engagement portion 62 in the inner surface of the operation handle 6, thereby limiting wear of the components.

The directions of the springs 8 distinctly differ between the lock position and the release position. This not only increases the operability but also facilitates identifying the position of the operation handle 6.

Movement of the operation handle 6 from the lock position to the release position releases the engagement between the fins 42 of the reel 4 and the fins 52 of the stopper 5, enabling the reel 4 to rotate freely to loosen the shoelace 2.

In contrast, when the operation handle 6 is moved downward from the release position to the lock position, the springs 8 move beyond the reverse positions, where the springs 8 are compressed the most, in the opposite direction, thereby bringing the fins 42 of the reel 4 and the fins 52 of the stopper 5 into engagement again. In this position, the shoelace 2 can be tightened by winding the shoelace 2 around the reel 4.

The "operation handle" as described herein may have any shape as long as it functions as an operation portion for driving the reel 4 to rotate. The operation handle may have a polygonal shape.

The present invention is not limited to the shoelace winding apparatus 1 that mainly tightens the instep of the shoe S. The present invention may be embodied as a shoelace winding apparatus 1 that tightens a different part of the shoe S, for example only the section around the opening of the shoe S.

The shoelace winding apparatus 1 may be attached to a position of the shoe S other than the heel section. The present invention may be embodied as a structure for attaching a shoelace winding apparatus 1 to the instep or a side section (near the ankle section) of the shoe.

The retention projections and depressions, which are formed in the inner circumferential surface of the cover portion 91 and the outer circumferential surface of the base member 3 so as to engage with one another when the base member 3 is rotated to limit outward removal of the base member 3, do not have to extend parallel to the bottom surfaces of the cover portion 91 and the base member 3. Such projections and depressions may extend spirally or obliquely along the inner circumferential surface of the cover portion 91 and the outer circumferential surface of the base member 3.

Within the principles of the present invention, the present invention may be embodied as a shoelace winding apparatus including components that differ in structure, material, shape, dimensions, angle, arrangement position, size, and number and a structure for attaching such a device. The present invention may be embodied as a shoelace winding apparatus having a shoelace winding system that differs from the example described above and a structure for attaching such a device.

INDUSTRIAL APPLICABILITY

The present invention provides comfortable shoes having shoelace winding apparatuses that are compact and light, resist breaking, and have high stability and durability in use. Moreover, the present invention may be embodied as a structure for attaching a shoelace winding apparatus that facilitates assembly, maintenance, and application to various types of shoes, such as general shoes for business, children, and women, in addition to athletic shoes.

DESCRIPTION OF THE REFERENCE NUMERALS

1 Shoelace winding apparatus
2 Shoelace
3 Base member
31 Cylindrical body with one closed end
31*a* Lower outer circumference section
32 Reel accommodation section
33 Rotation shaft
34 Annular gear
35 Shoelace outlet
36 Retention groove
37 Anti-rotation through-hole
4 Reel
41 Shaft receptacle
42 Fin
5 Stopper
51 Ratchet pawl
52 Fin
53 Coupling pawl
54 Shaft hole
6 Operation handle
61 Engagement hole
62 Engagement portion
63 Shaft hole
64 Locking step
7 Shaft
71 Shaft receptacle
72 Flange
73 Screw insertion hole
7*a* Screw
8 Spring
81 Shaft section (first end)
82 Spring section (second end)
9 Base-member attachment cover
91 Cover portion
92 Flange portion
92*a* Slit
93 Retention protrusion
94 Anti-rotation projection
95 Shoelace inlet
96 Shoelace guide section
10 Cap
11 Through-hole
12 Lining
13 Counter
14 Tube cover made of a nonwoven fabric
15 Cushion material made of EVA
16 Outer layer
100 Tool
300 Shoelace winding apparatus
301 Operation handle
302 Reel
303 Ratchet pawl
304 Base member
305 Flange
S Shoe
T shoelace insertion tube

The invention claimed is:

1. A structure for attaching a shoelace winding apparatus, wherein the shoelace winding apparatus includes:

a reel that is driven by an operation handle to rotate and wind a shoelace;

a ratchet pawl that limits rotation of the reel; and a base member including a substantially cylindrical body, which has one closed end and accommodates the reel, wherein the base member has an inner circumferential surface including an annular gear with a plurality of teeth that engages with the ratchet pawl, wherein a base-member attachment cover including:

a cover portion that is substantially cylindrical and has one closed end, wherein the cover portion is allowed to secure the base member such that the base member is directly attachable and detachable from outside of an upper section and held in the cover portion; and a flange portion that protrudes from a circumference of the cover portion and conforms to a shape of the shoe, wherein the cover portion or the base member includes a lock mechanism that locks the base member in a position secured to the cover portion, wherein the lock mechanism, which locks the base member in a position secured to the cover portion, includes:

retention protrusions and retention grooves that are formed in a circumferential surface of the cover portion and a circumferential surface of the base member respectively so as to engage with each other when the base member is rotated to limit outward removal of the base member; and an anti-rotation projection and an anti-rotation through-hole that are formed in an inner bottom surface of the cover portion and a lower surface of the base member respectively so as to engage with each other to maintain engagement between the retention protrusions and the retention grooves.

2. The structure for attaching a shoelace winding apparatus according to claim 1, wherein the base member cannot rotate in a direction that removes the base member when the anti-rotation projection is fit into the anti-rotation through-hole, and the anti-rotation projection is configured to be pressed from outside of the base member so as to be disengaged from the anti-rotation through-hole.

3. The structure for attaching a shoelace winding apparatus according to claim 1, wherein the flange portion includes a plurality of sections that are individually deformable.

4. The structure for attaching a shoelace winding apparatus according to claim 1, wherein the cover portion has a lower surface that is curved to conform to the shape of the shoe.

5. A structure for attaching a shoelace winding apparatus, wherein the shoelace winding apparatus includes:

a reel that is driven by an operation handle to rotate and wind a shoelace;

a ratchet pawl that limits rotation of the reel; and a base member including a substantially cylindrical body, which has one closed end and accommodates the reel, wherein the base member has an inner circumferential surface including an annular gear with a plurality of teeth that engages with the ratchet pawl, wherein a base-member attachment cover including:

a cover portion that is substantially cylindrical and has one closed end, wherein the cover portion is allowed to secure the base member such that the base member is directly attachable and detachable from outside of an upper section and held in the cover portion; and a flange portion that protrudes from a circumference of the cover portion and conforms to a shape of the shoe, wherein the cover portion or the base member includes a lock mechanism that locks the base member in a position secured to the cover portion, wherein the cover portion includes a shoelace inlet that opens to a cylindrical inner surface, a tubular shoelace guide section extends from the shoelace inlet and along the flange portion, a diameter of the shoelace guide section is reduced near the shoelace inlet, and the shoelace guide section is configured to receive a shoelace insertion tube such that a tip of the shoelace insertion tube is placed near the shoelace inlet.

6. The structure for attaching a shoelace winding apparatus according to claim 5, wherein the flange portion includes a plurality of sections that are individually deformable.

7. The structure for attaching a shoelace winding apparatus according to claim 5, wherein the cover portion has a lower surface that is curved to conform to the shape of the shoe.

8. A structure for attaching a shoelace winding apparatus, wherein the shoelace winding apparatus includes:

a reel that is driven by an operation handle to rotate and wind a shoelace;

a ratchet pawl that limits rotation of the reel; and a base member including a substantially cylindrical body, which has one closed end and accommodates the reel, wherein the base member has an inner circumferential surface including an annular gear with a plurality of teeth that engages with the ratchet pawl, wherein a base-member attachment cover including:

a cover portion that is substantially cylindrical and has one closed end, wherein the cover portion is allowed to secure the base member such that the base member is directly attachable and detachable from outside of an upper section and held in the cover portion; and a flange portion that protrudes from a circumference of the cover portion and conforms to a shape of the shoe, wherein the cover portion or the base member includes a lock mechanism that locks the base member in a position secured to the cover portion, wherein a gap exists between an outer circumferential surface of the base member and an inner circumferential surface of the cover portion so that deformation of the cover portion does not deform the base member.

9. The structure for attaching a shoelace winding apparatus according to claim 8, wherein the flange portion includes a plurality of sections that are individually deformable.

10. The structure for attaching a shoelace winding apparatus according to claim 8, wherein the cover portion has a lower surface that is curved to conform to the shape of the shoe.

* * * * *